US008888930B2

(12) United States Patent
Jerg et al.

(10) Patent No.: US 8,888,930 B2
(45) Date of Patent: Nov. 18, 2014

(54) DISHWASHING MACHINE HAVING SOUND PROOFING ELEMENT

(75) Inventors: Helmut Jerg, Giengen (DE); Bernd Schwenk, Lauingen (DE); Klaus Wietzel, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 762 days.

(21) Appl. No.: 13/144,935

(22) PCT Filed: Jan. 18, 2010

(86) PCT No.: PCT/EP2010/050499

§ 371 (c)(1),
(2), (4) Date: Jul. 18, 2011

(87) PCT Pub. No.: WO2010/086245

PCT Pub. Date: Aug. 5, 2010

(65) Prior Publication Data

US 2011/0271987 A1 Nov. 10, 2011

(30) Foreign Application Priority Data

Jan. 30, 2009 (DE) ..... 10 2009 000 524

(51) Int. Cl.
*B08B 3/00* (2006.01)
*A47L 15/42* (2006.01)
*G10K 11/165* (2006.01)

(52) U.S. Cl.
CPC ..... *A47L 15/4272* (2013.01); *G10K 11/165* (2013.01)
USPC ..... 134/56 D; 134/57 D

(58) Field of Classification Search
None
See application file for complete search history.

(56) References Cited

U.S. PATENT DOCUMENTS

| | | | | |
|---|---|---|---|---|
| 4,568,581 | A | 2/1986 | Peoples, Jr. | |
| 5,841,081 | A | 11/1998 | Thompson et al. | |
| 2003/0106741 | A1 | 6/2003 | Tompson et al. | |
| 2004/0023014 | A1 | 2/2004 | Williamson et al. | |
| 2005/0092353 | A1 | 5/2005 | Retsema | |
| 2008/0001431 | A1 * | 1/2008 | Thompson et al. | 296/187.01 |
| 2008/0128005 | A1 | 6/2008 | Haeberle et al. | |
| 2009/0205378 | A1 | 8/2009 | Helgesen | |

FOREIGN PATENT DOCUMENTS

| | | | |
|---|---|---|---|
| DE | 4110292 | A1 | 10/1992 |
| DE | 19959089 | A1 | 7/2001 |
| DE | 102006015498 | A1 | 10/2007 |
| EP | 0672524 | B1 | 5/1999 |
| WO | 0226100 | A2 | 4/2002 |
| WO | 2008117906 | A1 | 10/2008 |

OTHER PUBLICATIONS

International Search Report PCT/EP2010/050499.
Report of Examination—DE 10 2009 000 524.2.

* cited by examiner

*Primary Examiner* — Jason Ko
(74) *Attorney, Agent, or Firm* — James E. Howard; Andre Pallapies

(57) ABSTRACT

A dishwashing machine, in particular a household dishwashing machine, includes a box-shaped washing tank for receiving items to be washed, and a base carrier for support of the washing tank. The base carrier has a technology space for accommodating electrical components of the dishwashing machine. The technology space is arranged between a floor formed on the base carrier and the washing tank and is at least partially surrounded by a sound proofing element designed as a three-dimensional formed component.

24 Claims, 2 Drawing Sheets

DISHWASHING MACHINE HAVING SOUND PROOFING ELEMENT

BACKGROUND OF THE INVENTION

The present invention relates to a dishwashing machine, in particular a household dishwashing machine, having a box-shaped washing tank for receiving items to be washed, having a base carrier whereupon the washing tank is placed and having a technology space for accommodating electrical components of the dishwashing machine that is arranged between a base formed on the base carrier and the washing tank.

In practice, a household dishwashing machine comprises a box-shaped washing tank for instance which is arranged on a base carrier and is fastened hereto. The washing tank and the base carrier are arranged here in an exterior housing of the dishwashing machine. The box-shaped washing tank is preferably manufactured from a rust-resistant sheet metal, in particular a stainless steel panel and comprises a tank floor, two side walls, a rear wall and a roof element. It may alternatively, if necessary, also be composed of a U-shaped hood and a cover part or inserted part of the base carrier. A loading opening is provided on a front side of the dishwashing machine, which faces a user when the dishwashing machine is used conventionally, it being possible to close said loading opening by means of a moveable door. When the door is open, items to be washed can be introduced into the washing tank and/or washed items can be removed from the washing tank through the loading opening. By contrast, when the door is closed, an essentially closed dishwasher interior is produced inside the washing tank.

The dishes are cleaned when the door is closed, by rinsing water being applied to the items to be washed. To this end, a spray system is installed in particular in the washing tank, by way of which rinsing water with different temperatures can be sprayed into the dishwasher interior depending on the washing phase. As a function of the washing phase, detergent and/or additives are added to the rinsing water in order to be able to achieve a good washing and drying result.

While a dosing facility for the automatic addition of detergents and additives is preferably arranged for instance on an internal side of the washing tank or an internal side of the door, a technology space is provided for further components of the dishwashing machine, said technology space being arranged above a floor of the base carrier and below the washing tank. A circulating pump for feeding the spray system with rinsing water, a heating element for heating the rinsing water and a water switch, which is arranged between the circulating pump and the spray system, is usually found in the technology space, thereby intentionally providing individual spray elements of the spray system with rinsing water. A drain pump can also be provided in the technology space, said drain pump being used to pump off used rinsing water.

During operation of the dishwashing machine, the metallic washing tank is excited to vibrate by circulating rinsing water, said vibrations resulting in the emission of sound. In order to reduce sound emissions of this type, polymer-modified bitumen mats with an adjusted loss factor are adhered to the exterior of the washing tank. The adhered bitumen mats cause an additional mass to be applied to the thin sheet metal parts of the washing tank, thereby reducing their tendency to vibrate. Furthermore, the bitumen mats cause the vibrations to convert into heat as a result of internal friction. Nevertheless, the emission of airborne sound cannot be completely prevented by the bitumen mats.

During operation of the dishwashing machine, airborne sound is also generated and emitted by the electrical components of the dishwashing machine which are arranged in the technology space. In particular, electrically driven and/or electrically actuated components, such as in particular the drain pump, the circulating pump and/or the water switch, contribute to a sound generation of this type.

In order to reduce the outward propagation of the airborne sound which is produced in the region of the washing tank and in the region of the technology space, two-dimensional, in other words planar acoustic, components made of an absorption material are usually attached to the internal side of the exterior housing of the dishwashing machine. Acoustic components of this type are embodied as plates or mats with a minimal layer thickness and rest in a two-dimensional manner against the internal side of the exterior housing. They are therefore embodied as a thin layer and essentially feature the same layer thickness at each point of their plane. The plate-shaped acoustic components can be produced comparatively easily in particular as stamped parts made of an essentially two-dimensionally molded, i.e. original planar structure. The need for ever quieter dishwashing machines has developed over the past few years. This applies in the case of commercial dishwashing machines, particularly however in the case of household dishwashing machines. The latter is particularly justified in that a separation of kitchen and living quarters is increasingly dispensed with in modern homes.

The afore-cited dishwashing machine is disadvantageous in that it no longer fulfils the increased acoustic requirements.

BRIEF SUMMARY OF THE INVENTION

The object of the present invention therein consists in providing a dishwashing machine, in particular a household dishwashing machine, the noise emission of which is significantly reduced.

The object is herewith achieved in the case of a dishwashing machine of the type cited in the introduction in that the technology space is surrounded at least partially by a soundproofing element, which is embodied as a three-dimensionally molded component.

The use of a soundproofing element, which surrounds the technology space at least partially as a prefabricated molded component, makes it possible to hinder the spread of airborne sound generated in the technology space, particularly before it reaches the outside in the region of the exterior housing of the dishwashing machine or even in the spatial area outside of the dishwashing machine. The airborne sound generated in the technology space can be both sound which is generated directly by the electrical components arranged in the technology space, and also sound which is generated by vibrations of the tank floor of the washing tank.

The soundproofing element is embodied so as to prevent the outward spread of sound from the different components inside the technology space into a region outside the technology space, thereby causing a sound absorption and/or a sound damping. Sound absorption is herewith understood to mean a reduction in the emission of sound by reflection of the sound from the soundproofing element. Sound damping is by contrast understood to mean a reduction in the spread of sound by the absorption of sound, in other words by the conversion of sound energy into heat.

The three-dimensional molding enables the soundproofing element to be easily intentionally and/or specially, i.e. individually adjusted to the partially complex molded adjacent components in the dishwashing machine. It is particularly possible to embody the contour of the soundproofing element such that the soundproofing element can also be fitted to three-dimensionally molded regions of the base carrier and/or of the washing tank in an essentially gap-free fashion. A profiled structure is particularly suited to the three-dimensionally molded soundproofing element, which, in contrast to a purely planar, thin insulation mat or a planar insulation matting with a constant layer thickness has, in addition to its two-dimensional extension, one or more material moldings in an expansion plane which proceeds transverse thereto, in particular vertically thereto. It is therefore molded with spatial, i.e. three-dimensional contouring.

It is likewise possible to embody the soundproofing element such that in regions, in which a sound emission would be particularly bothersome, a greater material thickness is provided than in other regions of the soundproofing element. It is also possible to vary the material thickness of the soundproofing element such that a material accumulation is provided in the regions with the highest sound generation, said material accumulation resulting in a particularly good absorption and damping. The soundproofing element may therefore comprise a section for instance which directly surrounds a sound source, such as for instance a circulating pump. A section of this type may be for instance part of an essentially closed housing or encapsulation of the sound source.

A further advantage of the three-dimensional molding of the soundproofing element can consist in particular in that in accordance with an advantageous embodiment variant with only an individual, i.e. single soundproofing element, it is now possible to reduce a sound propagation on different sides, in particular in several boundary planes which differ from one another and delimit the technology space of the dishwashing machine. The manufacture of the inventive dishwashing machine is simplified in this way. In addition, the formation of cracks is prevented between several soundproofing elements. Overall, the inventive dishwashing machine is characterized by a significantly reduced sound emission.

In particular, the soundproofing element can be embodied as an individual, in particular one-piece or integrally formed inserted part, which complements the base carrier such that the technology space between the floor of the base carrier and the washing tank placed above the same is largely sealed in a sound-proofing fashion. It may be inserted here into the base carrier. Alternatively or in addition, it may also be molded such that it partially or wholly covers the exterior of the base carrier, particularly if sufficient space is present on the outside between the base carrier and the exterior housing of the dishwashing machine. It may preferably fill at least holes, cut-outs and/or openings in the base carrier.

According to an expedient variant, it may be embodied as an insertion frame, the exterior contour of which is embodied so as to complement the interior contour of the base carrier. As a result, the base carrier and the soundproofing element can interlink into one another and/or plug into one another. In accordance with this advantageous embodiment variant, the base carrier thus forms an insert in the base carrier. This facilitates assembly when installing the dishwashing machine. The soundproofing element can similarly, if necessary, also be embodied as an exterior frame for the base carrier, which renders this soundproof. If necessary, it is also possible to mold the soundproofing element three-dimensionally such that it partially or wholly encloses the base carrier both internally and also externally or at least complements or fills its openings, recesses, cut-outs, thinning points and/or others in a sound-damping and/or sound-absorbing fashion.

In particular, it may be expedient to embody the soundproofing element and install the same in the base carrier or plug the same into the base carrier such that in the event of a service and/or repair it can be removed from the technology space by an engineer or fitter from the front, so that its components are freely accessible. Conversely, after concluding the service work, it can also be easily reinserted or plugged back into its assembly position in and/or on the base carrier.

In particular, it may be expedient to embody the inventive soundproofing element as an integrally formed and/or one-piece structure or mono component. As a result, when manufacturing and/or assembling the dishwashing machine, it can be installed in the technology space between the base carrier and the washing tank in a particularly user-friendly and simple fashion. In the event of a service, it can easily be removed as a single component from the technology space.

A three-dimensionally molded soundproofing element is understood within the scope of the invention to mean in particular a structure and/or a molded structure, which, contrary to a purely planar, thin soundproofing element, which has a constant layer thickness, extends in at least two spatial planes, which proceed transversely, in particular at right angles to one another. This spatial structure of the soundproofing element deviates from a planar, thin plate shape, in other words as a result of its three dimensional molding. In particular, it comprises one or more moldings inwards and/or outwards in a transverse, preferably vertical fashion relative to its two-dimensional extension. Its three-dimensional geometry enables this molded component to be adjusted to different internal contours, external contours, i.e. in general terms designs of the base carrier, in an improved fashion.

In accordance with an advantageous development of the invention, the three-dimensionally molded soundproofing element includes in particular only a three-dimensionally structured front wall, which rests against a front region of the base carrier and if necessary against a front region of the washing tank, in particular in the region of its nozzle. A front wall is herewith understood to mean such a wall, which is provided on a loading side of the washing tank. The front wall can herewith expediently rest against the front region of the base carrier and if necessary against the front region, in particular so-called nozzle region, of the washing tank, across a significant part of the width of the dishwashing machine in an essentially gap-free fashion. The emission of sound towards the front side of the dishwashing machine, which is particularly bothersome during operation of the dishwashing machine, can be effectively reduced. The so-called tank nozzle is embodied on the front side of the washing tank, which delimits a loading opening of the washing tank on its underside. The tank nozzle is in this way raised relative to the tank floor of the washing tank in the upward direction, preferably at an angle which increases outwardly, so that a type of floor pan is formed in the region of the front loading opening of the washing tank.

In particular, it may be expedient if the premolded soundproofing element in the region of the front side of the technology space follows an inwardly aligned bulge which is provided in the upper half of the front side of the technology space, said bulge serving to receive an overhang of the door, which this has relative to its axis of rotation in its respective open position. This inner bulge is therefore used as a pivoting range for the respective door overhang. The soundproofing element herewith preferably extends essentially in the vertical direction in the lower region of the technology space. In this way the soundproofing element is generally expressed, in accordance with an advantageous embodiment variant, as a premolded three-dimensional profiled element, which, in the base carrier lines or clads the technology space with a front wall structure with at least two moldings which lie offset from one another in the depth direction.

According to a preferred development of the invention, the soundproofing element includes a front wall, which seals a front opening of the technology space placed between the floor and the washing tank. The base carrier can comprise upward, in particular vertically, protruding support elements on its front side, on which support elements the washing tank is mounted. One or more openings can be located in this instance between the support element, said openings being sealed by the soundproofing element in each instance. This largely prevents airborne sound from being able to escape out of the technology space through these one or more openings. In particular, the three-dimensionally molded soundproofing element may comprise two sheathing structure planes, which are offset from one another in the depth direction of the base carrier and/or lie graduated relative to one another, if it lines the front of the technology space, preferably a front opening in the base carrier, and the washing tank is arranged offset relative to the base carrier in the depth direction, in particular set back relative thereto.

According to an advantageous development of the invention, the soundproofing element comprises side walls which face one another, said side walls resting against a lateral region of the base carrier and a lateral region of the washing tank. In this way a sound propagation via the sides of the dishwashing machine can be significantly reduced. As a second structural formation of the three-dimensional soundproofing element, the side walls can be connected to an, if necessary, existing front wall as a first structural formation, so that a direct propagation of airborne sound is also prevented in the front corner regions of the dishwashing machine.

According to an advantageous development of the invention, the soundproofing element comprises side walls which face one another, said side walls each sealing a lateral opening which is positioned between the floor and the washing tank. In addition to the front support elements mentioned previously, the said base carrier comprises a guiding arrangement on its rear corners in each instance, which serves to fix the washing tank. An opening and/or a passage or cutout is found here in each instance between a front support element and a rear guiding arrangement. The soundproofing element being embodied such that these openings are sealed allows a lateral sound emission to be significantly reduced.

According to a further expedient development of the invention, the soundproofing element comprises a floor section, which is arranged on a top face of the floor of the base carrier. This effectively reduces the floor of the base carrier, which is generally embodied with thin walls, from vibrating. The effect whereby the floor vibrates and as a result airborne sound is emitted outwards can herewith be reduced. The floor section of the soundproofing element can be connected to one or more walls, in particular the front wall and/or the side walls, of the soundproofing element, along its edges. This results in a particularly effective reduction of the sound emission.

In particular, it may be expedient to leave out this rear wall of the soundproofing element in order to enable an adequate heat dissipation outwards for the technical components inside the technology space. The then possible rearward noise emission is however then particularly not bothersome if the dishwashing machine is integrated into a fitted recess, as in a kitchen unit for instance, since the rear wall of the fitted recess is, to a certain degree, already sound-absorbing and/or sound-damping.

According to a further expedient development, the soundproofing element also includes, if necessary, a rear wall, which rests against a rear region of the base carrier and against a rear region of the washing tank. During operation of the dishwashing machine, a sound emission by way of the rear side of the dishwashing machine can herewith also be reduced. In this way the rear wall can connect directly to the rear ends of side walls of the soundproofing element and/or its floor section which is provided if necessary. The noise reduction is herewith further improved.

According to an expedient development of the invention, the soundproofing element includes a rear wall, which seals a rear opening between the floor and the washing tank. An opening of this type may exist for instance in the region of the rear guiding arrangements or therebetween.

According to a further expedient development of the invention, the soundproofing element is essentially produced from a carrier material, in particular phenol resin, and from filler materials incorporated therein, in particular cotton fibers and/or polyester fibers. The combination of a carrier material with filler materials incorporated therein enables the acoustic properties of the soundproofing element to be precisely adjusted to the respective requirements. In particular, phenol resin and fibers incorporated therein enable the soundproofing element to be equipped with almost any three-dimensional form. Furthermore, a combination of this type comprises good absorption and damping properties.

The three-dimensional molded component of the soundproofing element can be formed in particular by a premolded, i.e. prefabricated component, which also then largely retains its original, prefabricated profiled form if it is integrated in the clearance below the floor of the washing tank, in particular in the base carrier. It may in particular be embodied as a cladding part with a predetermined, three-dimensional geometrical shape, which is self-contained, i.e. self-supporting both in the unassembled and in the assembled state. It can preferably be embodied in a fashion which is largely stiff on demolding.

According to a preferred development of the invention, the soundproofing element is held in its intended position so as to be removable. Here the soundproofing element can expediently be form-fit, force-fit and/or frictionally-engaged, and or mounted, in particular fixed by another mechanical fitting or catch in the base carrier. In this way it is possible to remove the soundproofing element if maintenance work is to be carried out in the technology space, thereby simplifying such maintenance activities.

According to a particularly preferred development of the invention, the soundproofing element is embodied and arranged such that it can be removed from its intended position when the washing tank is placed on the base carrier. If the soundproofing element is removed, the technology space is accessible for maintenance work through openings embodied on the base carrier. At least smaller maintenance work in the technology space can be implemented in this way, without laboriously having to remove the washing tank from the base carrier.

In summary, the installation of a three-dimensionally molded soundproofing element provides for a further reduction in the acoustic power emission during operation of a fully automatic dishwashing machine, particularly by means of an improved airborne sound absorption and airborne sound reflection in the technology space region. The soundproofing element provided is advantageously used to absorb and damp the airborne sound. This combination allows for a further reduction in the acoustic power level. The soundproofing element is a three-dimensional molded component, which can, in an advantageous exemplary embodiment, be outwardly removed from the base carrier in order to implement maintenance work and/or can be removed from the technology space of the dishwashing machine. The soundproofing element can preferably be embodied such that it seals all the openings between the base carrier and the washing tank, through which airborne sound could escape from the technology space region into the kitchen region. It therefore outwardly encapsulates the technology space as a single component, if necessary together with the base carrier. In particular, it can line the technology space as an integrally formed component, if necessary together with the base carrier, in at least two boundary planes which differ in terms of location. It can preferably circumferentially encase the technology space. The soundproofing element advantageously consists of a material which comprises noise-absorbing and noise-reflecting properties.

Other developments of the invention are reproduced in the subclaims.

BRIEF DESCRIPTION OF THE DRAWINGS

The invention and its developments are subsequently explained in more detail with the aid of figures, in which.

DETAILED DESCRIPTION OF EXEMPLARY EMBODIMENTS OF THE PRESENT INVENTION

Figure 1:
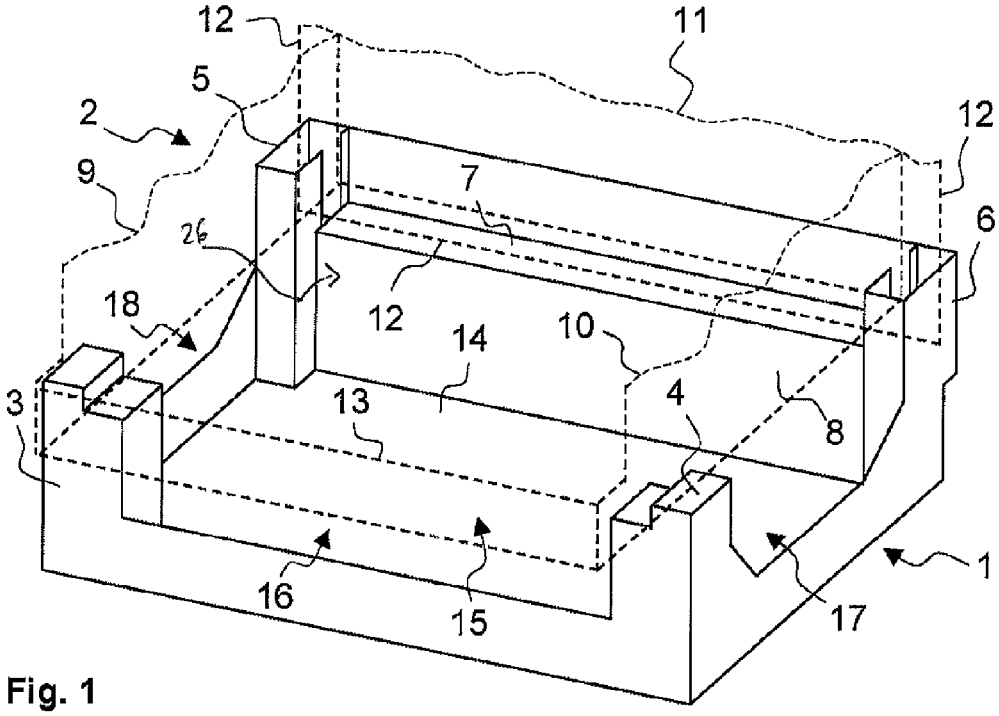
FIG. 1 schematically shows a spatial representation of a base carrier with a fitted washing tank of a first advantageous exemplary embodiment of an inventive household dishwashing machine, FIG. 2 schematically shows the base carrier and the washing tank in FIG. 1 with a fitted soundproofing element, FIG. 3 schematically shows a spatial representation of a base carrier with a fitted washing tank of a second advantageous exemplary embodiment of an inventive dishwashing machine.

Elements with the same function and mode of operation are provided with the same reference characters in FIGS. 1 to 4 respectively.

FIG. 1 shows a schematic spatial representation of a base carrier 1 of a first advantageous exemplary embodiment of an inventive household dishwashing machine. A washing tank 2 made of sheet steel is fitted on the base carrier 1, of which the contours of a lower section are shown by dashed lines. In order to be able to better represent the details of the base carrier 1, the washing tank 2 is shown as 'transparent'.

The base carrier 1 made from plastic comprises a complex three-dimensional molding. It surrounds a technology space 15 in the manner of a box. The base carrier 1 comprises a front support element 3 at a first corner region, on a front side which faces a user during operation of the dishwashing machine, and a front support element 4 on a second corner region which lies opposite in the widthwise direction of the base carrier 1. A first guiding arrangement 5 is provided on a first corner region at a rear of the base carrier 1 which faces away from the user during the wash mode and a second guiding arrangement 6 is provided on a second corner region which lies opposite in the widthwise direction of the base carrier. An essentially horizontally proceeding, planar bearing surface 7 for the washing tank 2 is provided on the base carrier 1 between the first guiding arrangement 5 and the second guiding arrangement 6.

The washing tank 2 includes a tank base 8, a first side wall 9, a second side wall 10, a rear wall 11 and a top wall (not shown). A rear wall flange 12 runs along the edge of the rear wall 11, with a first lateral section of the rear wall flange 12 serving to connect the rear wall 11 to the first side wall 9, a second lateral section of the rear wall flange 12 serving to connect the rear wall 11 to the second side wall 10 and a lower section of the rear wall flange 12 serving to connect the rear wall 11 to the tank base 8. An upper section of the rear wall flange 12 (not shown here) serves to connect the rear wall 11 to the top wall (not shown). A so-called tank nozzle 13 is embodied on the front side of the washing tank 2, said tank nozzle delimiting a loading opening of the washing tank 2 on its underside. The tank nozzle is thus raised relative to the tank base 8 in the height direction, preferably increasing at an angle, so that a type of base plate is formed in the region of the front loading opening of the dishwashing machine. The loading opening can be sealed by a pivotable door (not shown), with the tank nozzle 13 being used so that no water can escape between the door (not shown) and the tank base 8 during operation of the dishwashing machine.

In its front corner regions, the washing tank 2 rests against the front support elements 3, 4 of the base carrier 1. Furthermore, the lower section of the rear wall flange 12 of the washing tank 2 also rests against the bearing surface 7 of the base carrier 1. In this way, the weight of the washing container 2 is supported by the front support elements 3, 4 and the bearing surface 7. As a result of a form-fit connection, the guiding arrangements 5, 6 embodied on the base carrier 1 counteract a displacement of the washing tank 2 in respect of the base carrier 1 in the direction to the front side or in the direction to the rear of the dishwashing machine. The guiding arrangements 5, 6 also bring about a lateral guidance of the washing tank 2 in conjunction with the front support elements 3, 4.

A technology space 15 is provided between a floor 14 of the base carrier 1 and the tank floor 8 of the washing tank 2, said technology space serving to accommodate electrical components of the dishwashing machine which are not shown. An electrically operated circulating pump, an electrically operated drain water pump and an electrically controlled water switch (all of which are not shown) are in particular arranged in the technology space 15. These and if necessary further electrical components of the dishwashing machine generate noises during operation of the dishwashing machine, which noises could be perceived as bothersome in the surroundings of the dishwashing machine. The noises can herewith be emitted outwards for instance such that the base carrier 1 is excited to vibrate, which can then be perceived as noise outside of the technology space 15. Noises can however also escape outwards directly as airborne sound by way of one or more openings 16, 17, 18 in the base carrier and/or which are placed between the base 14 of the base carrier 1 and the tank base 8 of the washing tank 2. In particular, an access opening can be provided in the region of the front side of the base carrier, by way of which access opening the technology space 15 is accessible in the event of repairs or maintenance for instance. During operation of the dishwashing machine, sound can escape forwards out of this access opening, which would result in particularly unpleasant, unwanted noise propagation in the installation area in which the dishwashing machine is installed.

Figure 2:
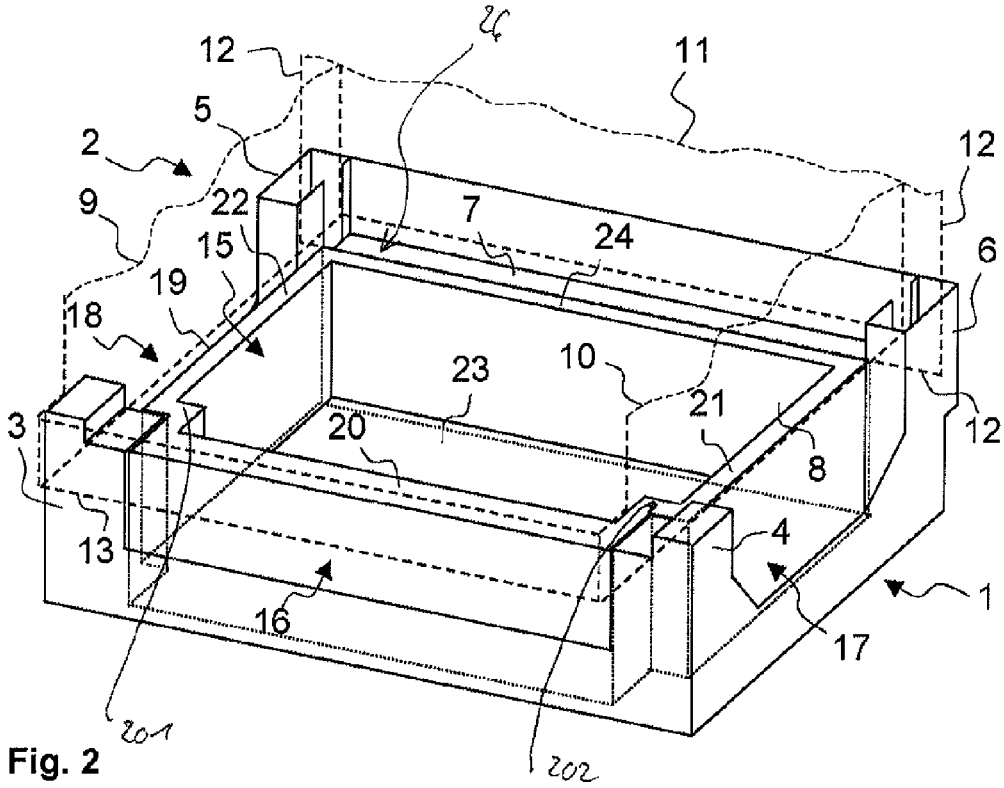

In order to minimize or largely prevent a sound emission from the technology space 15, a three-dimensionally molded soundproofing element 19 is now provided, which is shown in FIG. 2 in its fitted position between the base carrier 1 and the washing tank 2. The soundproofing element 19 comprises a front wall 20, a first side wall 21, a second side wall 22, a rear wall 24 and a floor section 23. These form a prefabricated molded component, the exterior contour of which follows the interior contour of the base carrier and/or its upper edge follows the contour of the undersurface of the washing tank. In other words, the soundproofing element forms a type of panel which can be introduced, in particular inserted into the base carrier and the profile shape of which is embodied such that it complements the base carrier, in particular clads it so that the technology space is encapsulated at least on its front side, in particular also along its side walls and if necessary also on its rear wall. Here the molded component of the soundproofing element seals any gaps, passages, openings, cutouts or suchlike in the base carrier. In particular, it lies flush with its upper edge on the undersurface of the washing tank, i.e. it contacts and/or abuts the same.

In the exemplary embodiment in FIG. 2, the three-dimensionally premolded front wall 20 with its lower section and with its lateral flange-type sections 201, 202 rests here in an essentially gap-free fashion against the base carrier 1 and seals its front access opening 16. By contrast, on its upper side, the front wall 20 rests in a largely gap-free fashion against the undersurface of the washing tank 2, so that the front side 16 of the technology space 15 is largely completely sealed. The front wall of the molded component has the contoured flange sections 201, 202 at its both ends in the transition region with respect to its side walls 21, 22, said flange sections running transverse, in particular at right angles to the plane of lie of its essentially planar front wall. Here the flange sections 201, 202 encompass and/or encase the support elements 2, 3 in a two-dimensional fashion. The respective flange section comprises an exterior contour in the exemplary embodiment here such that it covers the interior wall and an edge section of the rear wall of the associated support element which is connected thereto. Its exterior contour therefore follows the interior contour in the corner region of the base carrier. This can significantly reduce the escape of airborne sound from the technology space 15 to the front side of the dishwashing machine. The front wall 20 nevertheless also brings about a reduction in a possible vibrational excitation in the front region of the base carrier 1. The front wall 20 therefore merges into the side walls 21 and 22 of the soundproofing element 19 at its lateral end regions without interruption so that an excitation of the front support elements 3, 4 to vibrate is essentially prevented. In particular, the soundproofing element 19 is three-dimensionally formed in its two front corner regions such that its exterior contour is embodied so as to complement the interior contour of the base carrier in the region of its front support elements.

The side walls 21 and 22 of the soundproofing element 19 likewise rest in each instance against the base carrier 1 and against the washing tank base 8. A lateral escape of airborne sound through the lateral openings 17 and 18 is herewith practically prevented. Similarly, an excitation of the lateral sections of the base carrier 1 to vibrate is at least significantly reduced.

The rear wall 24 of the soundproofing element likewise lies against the underside of the washing tank 2 and the base carrier 1 in a largely gap-free fashion. It herewith connects the rear ends of the side walls 21 and 22 of the soundproofing element 19, so that in a top view, the walls 20, 21, 22, 24 essentially take the form of a rectangle. In spatial terms, the soundproofing element therefore forms an upwardly open, rectangular box. The rear wall 24 serves above all to prevent vibrations of the base carrier 1 at its rear end and/or its rear wall 26.

In general terms, the soundproofing element is therefore embodied as a molded component such that this complements the base carrier in a cladding fashion such that an encapsulation or housing for the technology space is provided at least on the front side and if necessary additionally on the two side walls. In the exemplary embodiment here, the molded component also clads the base carrier on its rear wall so that the technology space is enclosed around its external periphery.

In particular, it may be expedient if the premolded soundproofing element, in the region of the front side of the technology space, follows an inwardly aligned bulge which is provided in the upper half of the front side of the technology space, said bulge serving to accommodate an overhang of the door which this has relative to its axis of rotation in its respective open position. This inner bulge is therefore used as a pivoting range for the respective door overhang. The soundproofing element extends here in the lower region of the technology space, preferably essentially in a vertical direction. In this way, the soundproofing element is, in general terms in accordance with an advantageous embodiment variant, embodied as a premolded three-dimensional profiled element, which lines or clads the technology space in the base carrier with a front wall structure with at least two moldings which lie offset relative to one another in the depth direction.

The floor section 23 of the soundproofing element 19 extends between the undersides of the walls 20, 21, 22, 24 of the soundproofing element 19. It rests here on the base 14 of the base carrier 1 and prevents in particular vibrational excitation of the underside of the base carrier 1. A downward emission of sound can herewith be significantly reduced. Overall, the soundproofing element 19 prevents the escape of sound out of the technology space 15 downwards, forwards, to the rear and to the sides of the dishwashing machine. The upward emission of sound is at least significantly reduced by the washing tank 2, which sound is absorbed by means of bitumen mats (not shown). Conversely, the soundproofing element 19 prevents vibrations, which are generated on the underside of the washing tank 2 by impacting washing water, from being dissipated outwards via the technology space 15 as airborne sound. If necessary, the soundproofing element may also include a cover element, which rests against the underside of the floor of the washing tank and seals the technology space from the washing tank underfloor.

The soundproofing element 19 has a three-dimensional form, which is preferably precisely adjusted to the form of the base carrier 1 and similarly also to the form, in particular to the contour of the underfloor, of the washing tank 2. The silencing can herewith be maximized, without reducing the size of the technology space 15 too much. Furthermore, the soundproofing element 19 has a material thickness which varies from section to section. The largest material thickness is provided on the front wall 20 for instance, since an emission of sound would be perceived as particularly bothersome here. Overall, the soundproofing element 19 allows for an effective reduction in the radiated acoustic power, without any greater assembly effort, since only a single soundproofing element 19 is assembled during its manufacture in order to encapsulate and/or enclose sound in the technology chamber of the dishwashing machine and it is not necessary to install several separate soundproofing parts, which would be too complicated. The soundproofing element 19 can be manufactured from cotton fibers bonded with phenol resin for instance. A material mix of this type provides for a simple manufacture of the soundproofing element 19, for instance using a press-molding or casting method, and comprises good sound absorbing and sound damping properties.

Figure 3:
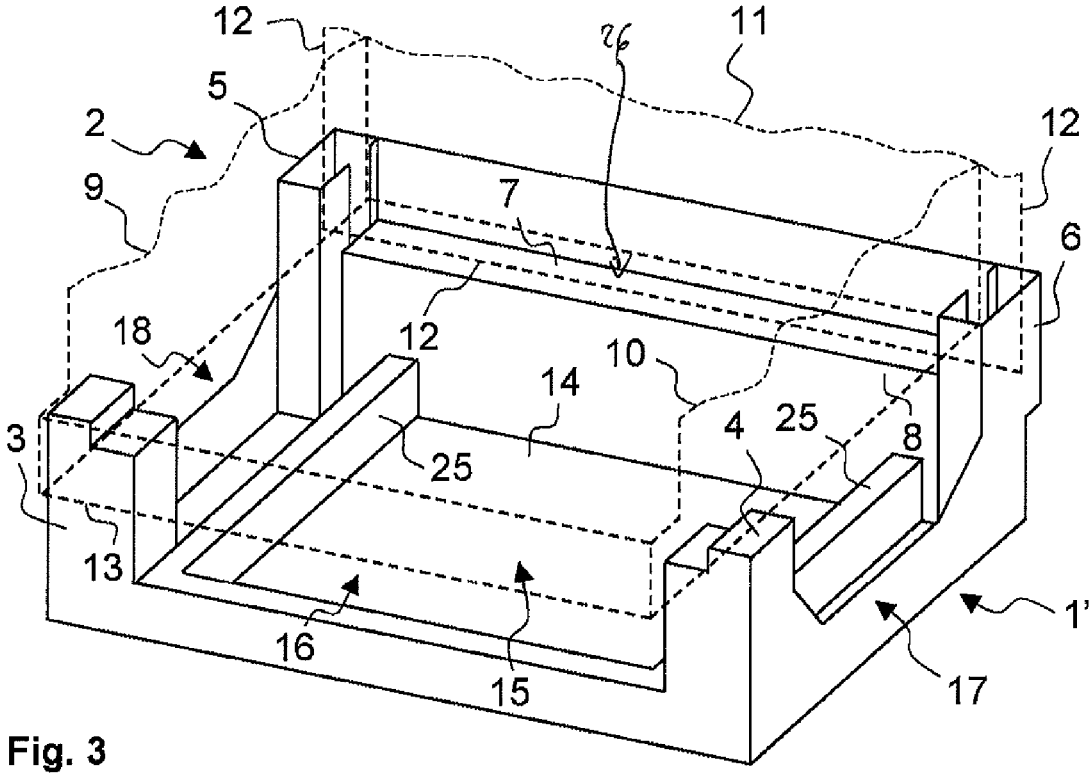

FIG. 3 shows a modified base carrier 1' and a lower section of the washing tank 2 mounted thereupon of a further advantageous exemplary embodiment of an inventive dishwashing machine. The essential difference in respect of the previously displayed base carrier 1 consists in a web arrangement 25 being provided on the top face of the base 14, said web arrangement extending in the depth direction of the base carrier from the front side opening 16 to the rear side bearing surface 7 and which comprises a bearing surface for a modified soundproofing element 19' on its top side. The web arrangement 26 forms, together with the top edge and/or the upper edge of the front wall of the base carrier, an integrally formed, U-shaped molded component with the same bearing height, the two exterior webs of which abut the rear wall 24 of the base carrier at the rear. This rear wall can be omitted if necessary so that heat from the technology space can escape to the rear there.

Figure 4:
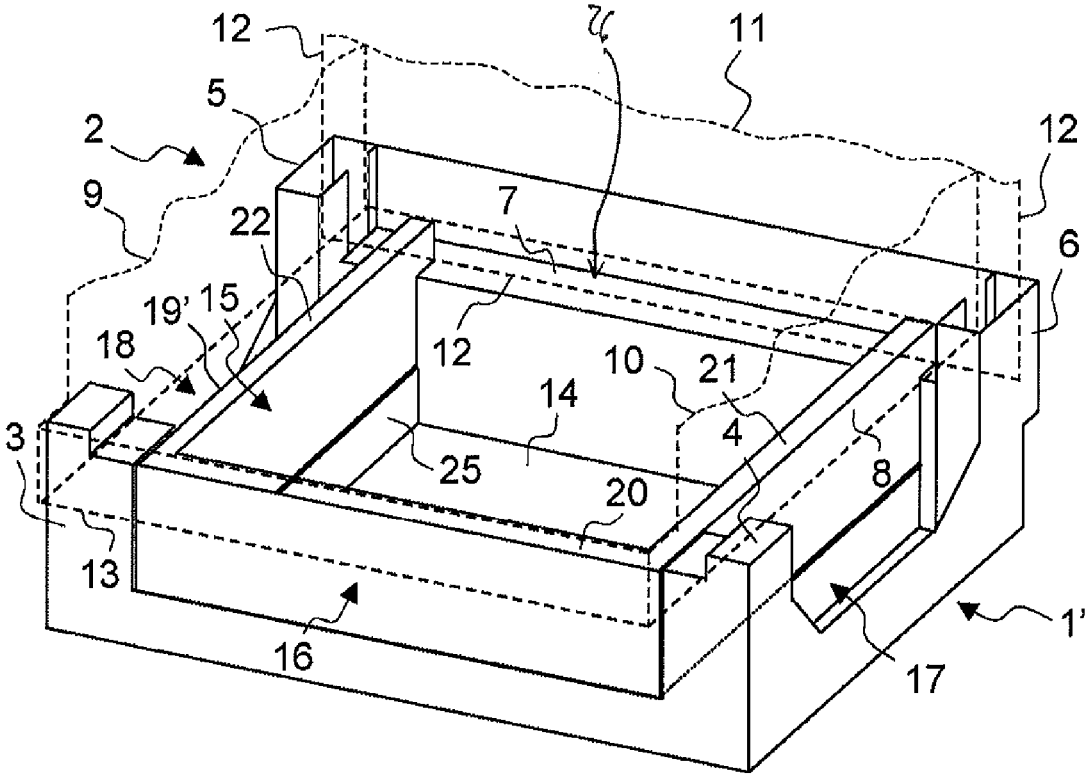
FIG. 4 shows the base carrier and the washing tank in FIG. 3 with a fitted soundproofing element.

FIG. 4 shows the base carrier 1' and the washing tank 2 in FIG. 3, with a modified soundproofing element 19' being assembled. The soundproofing element 19' has a front wall 20, a first side wall 21 and a second side wall 22, i.e. it is embodied with a U-shape and follows the contours of the web arrangement 25 and the upper edge of the recess and/or the cutout in the front wall of the base carrier. These three walls 20, 21, 22 rest with their undersides against the web arrangement 25 and upper edge of the recess and/or of the cutout in the front wall of the base carrier in a gap-free fashion in each instance. The top faces of the walls 20, 21, 22 lie against the underside of the washing tank 2 so that the front side opening 16 and the lateral openings 17, 18 are sealed by the soundproofing element 19'.

The molding and the mounting of the soundproofing element 19' enables the soundproofing element 19' to be removed from the dishwashing machine in a largely barrier-free fashion by a simple forward pulling motion, even when the washing tank 2 is fitted to the front side. In this way, the technology space 15 is accessible via openings 16, 17, 18, so that maintenance work is possible in the technology space 15, without the washing tank 2 having to be removed from the base carrier 1'. The soundproofing element 19' outwardly seals all the openings in the region of the technology space 15, so that an escape of airborne sound is essentially prevented. A possible vibrational excitation of parts of the base carrier 1', for instance in the region of the floor 14, can herewith be counteracted in particular such that the exposed parts are additionally insulated and/or damped on their exterior.

In general, it may be particularly expedient if the premolded soundproofing element has a three-dimensional housing structure, which partially or wholly surrounds and/or encases the technology space in at least two different boundary planes. It may be expedient for instance if the soundproofing element partially or wholly encompasses the technology space in the region of its front side and in the region of its side walls. In addition or independently hereof, the three-dimensional soundproofing element can have a structure component which is arranged in the region of the base, the rear side and/or the top of the technology space.

LIST OF REFERENCE CHARACTERS

1. base carrier
2. washing tank
3. front support element
4. front support element
5. guiding arrangement
6. guiding arrangement
7. bearing surface
8. tank base
9. first side wall
10. second side wall
11. rear wall
12. rear wall flange
13. tank nozzle
14. base
15. technology space
16. front opening
17. first lateral opening
18. second lateral opening
19. soundproofing element
20. front wall
21. first side wall
22. second side wall
23. base section
24. rear wall
25. web arrangement
26. rear wall of the base carrier

The invention claimed is:

1. A dishwashing machine, comprising:

a box-shaped washing tank for receiving items to be washed;

a base carrier supporting the washing tank; said base carrier at least partially surrounding a perimeter of a technology space when viewed from above the dishwashing machine, the technology space accommodating electrical components of the dishwashing machine, said technology space being arranged between a floor formed on the base carrier and an undersurface of the washing tank; and a soundproofing element designed as a three-dimensional molded component and at least partially surrounding the technology space along a portion of at least two sides of the perimeter of the technology space.

2. The dishwashing machine of claim 1, constructed in the form of a household dishwashing machine.

3. The dishwashing machine of claim 1, wherein the soundproofing element includes a front wall, which rests against a front region of the base carrier and against a front region of the washing tank.

4. The dishwashing machine of claim 1, wherein the soundproofing element includes a front wall, which seals a front opening placed between the floor and the washing tank.

5. The dishwashing machine of claim 1, wherein the soundproofing element comprises side walls which face one another, each of the side walls on opposite sides of the perimeter of the technology space and resting against a lateral region of the base carrier and against a lateral region of the washing tank.

6. The dishwashing machine of claim 1, wherein the soundproofing element comprises side walls which face one another, said side walls being on opposite sides of the perimeter of the technology space and sealing a lateral opening placed between the floor and the washing tank.

7. The dishwashing machine of claim 1, wherein the soundproofing element comprises a base section which is arranged on an upper side of the floor of the base carrier and within the perimeter of the technology space.

8. The dishwashing machine of claim 1, wherein the soundproofing element includes a rear wall which rests against a rear region of the base carrier and a rear region of the washing tank.

9. The dishwashing machine of claim 1, wherein the soundproofing element includes a rear wall which seals a rear opening between the floor and the washing tank.

10. The dishwashing machine of claim 1, wherein the soundproofing element is essentially manufactured from a carrier material and from a filler material incorporated therein.

11. The dishwashing machine of claim 10, wherein the carrier material is phenol resin.

12. The dishwashing machine of claim 10, wherein the filler material includes at least one of cotton fibers and polyester fibers.

13. The dishwashing machine of claim 1, wherein the soundproofing element is removably held in its intended position.

14. The dishwashing machine of claim 1, wherein the soundproofing element is embodied and arranged so as to be removable from its intended position when the washing tank is placed on the base carrier.

15. The dishwashing machine of claim 1, wherein the soundproofing element comprises:

a front wall extending along at least a portion of a front of the perimeter of the technology space; and a sidewall extending from the front wall in a direction substantially transverse to the front wall, the sidewall extending along at least a portion of a side of the perimeter of the technology space.

16. The dishwashing machine of claim 15, wherein the soundproofing element comprises:

a second sidewall extending from the front wall in the direction substantially transverse to the front wall, the second sidewall being on an opposite side of the technology space from the sidewall and extending along at least a portion of a second side of the perimeter of the technology space.

17. The dishwashing machine of claim 15, wherein the soundproofing element comprises:

a rear wall extending along at least a portion of a rear of the perimeter of the technology space, the rear wall being on an opposite side of the technology space from the front wall.

18. The dishwashing machine of claim 15, wherein the soundproofing element comprises:

a base section extending along at least a portion of the floor formed on the base carrier and within the perimeter of the technology space.

19. The dishwashing machine of claim 18, wherein the soundproofing element comprises:

a rear wall extending along at least a portion of a rear of the perimeter of the technology space, the rear wall being on an opposite side of the technology space from the front wall.

20. The dishwashing machine of claim 1, wherein the soundproofing element has an exterior contour following an interior contour of the base carrier along the portion of the at least two sides of the perimeter of the technology space, and an upper edge following a contour of the undersurface of the washing tank.

21. The dishwashing machine of claim 1, wherein the base carrier includes a support element at a front corner of a front of the perimeter of the technology space; and wherein the soundproofing element includes:

a front wall extending along at least a portion of the front of the perimeter of the technology space; and a flange section extending from the front wall in a direction substantially transverse to the front wall along an internal side of the support element of the base carrier.

22. The dishwashing machine of claim 21, wherein the flange section further includes a portion extending in a direction substantially parallel to the front wall and along a second internal side of the support element.

23. The dishwashing machine of claim 1, wherein the soundproofing element has a first section having a first material thickness and a second section having a second material thickness, wherein the first material thickness is different than the second material thickness.

24. The dishwashing machine of claim 15, wherein the front wall has a first material thickness extending in a direction substantially transverse to the front of the perimeter of the technology space, wherein the sidewall has a second material thickness extending in a direction substantially transverse to the side of the perimeter of the technology space; and wherein the first material thickness is greater than the second material thickness.

* * * * *